US007583234B2

(12) United States Patent
Iwata et al.

(10) Patent No.: US 7,583,234 B2
(45) Date of Patent: Sep. 1, 2009

(54) ANTENNA DEVICE

(75) Inventors: Hideki Iwata, Shinagawa (JP); Shigemi Kurashima, Shinagawa (JP); Masahiro Yanagi, Shinagawa (JP); Takashi Yuba, Shinagawa (JP); Takashi Arita, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 25 days.

(21) Appl. No.: 11/783,291

(22) Filed: Apr. 6, 2007

(65) Prior Publication Data

US 2008/0062047 A1 Mar. 13, 2008

(30) Foreign Application Priority Data

Sep. 13, 2006 (JP) ..... 2006-248631

(51) Int. Cl.
*H01Q 1/38* (2006.01)
*H01Q 9/28* (2006.01)

(52) U.S. Cl. ..... 343/795; 343/846

(58) Field of Classification Search ..... 343/700 MS, 343/767, 792, 795, 846
See application file for complete search history.

(56) References Cited

U.S. PATENT DOCUMENTS 5,594,455 A * 1/1997 Hori et al. ..... 343/700 MS
5,754,145 A * 5/1998 Evans ..... 343/795
6,396,456 B1 * 5/2002 Chiang et al. ..... 343/795
6,603,439 B2 * 8/2003 Ngo Bui Hung et al. .... 343/793
2004/0100406 A1 * 5/2004 Okado ..... 343/700 MS

FOREIGN PATENT DOCUMENTS

JP 2000-196327 7/2000

OTHER PUBLICATIONS

Taniguchi, T. and Takehiko Kobayashi (Tokyo Denki University); "An Omnidirectional and Low-VSWR Antenna for the FCC-approved UWB Frequency Band," Institute of Electronics, Information, and Communications Engineers, B-1-133, B201, Mar. 22, 2003.

* cited by examiner

*Primary Examiner*—Michael C Wimer
(74) *Attorney, Agent, or Firm*—Staas & Halsey LLP

(57) ABSTRACT

An antenna device is disclosed that includes a dielectric substrate having first and second surfaces facing away from each other, an element pattern formed on the first surface of the dielectric substrate, a conductive pattern formed on the first surface of the dielectric substrate so as to extend from the feeding point of the element pattern, and a ground pattern formed on the second surface of the dielectric substrate so as to form a microstrip line in cooperation with the conductive pattern. The ground pattern has a cutout part formed in a portion thereof opposing the feeding point.

10 Claims, 11 Drawing Sheets

ANTENNA DEVICE

CROSS REFERENCE TO RELATED APPLICATIONS

The present application is based on Japanese Priority Patent Application No. 2006-248631, filed on Sep. 13, 2006, the entire contents of which are hereby incorporated by reference.

BACKGROUND OF THE INVENTION

1. Field of the Invention

The present invention relates generally to antenna devices, and more particularly to an antenna device having an element pattern and a microstrip line extending from the feeding point of the element pattern formed on one side (surface) of a dielectric substrate, and having a ground pattern opposing the microstrip line formed on the other side (surface) of the dielectric substrate.

2. Description of the Related Art

In these years, a radio communications technology using UWB (Ultra Wideband), which enables radar positioning and communications at high data transfer rate, has attracted attention. Since 2002, USB has been approved for use in a frequency band of 3.1 to 10.6 GHz by the U.S. FCC (Federal Communications Commission).

UWB is a communication method that communicates pulse signals in an ultra wideband. Accordingly, antennas used for UWB are required to have a configuration that enables transmission and reception in an ultra wideband.

As an antenna for use in at least the FCC-approved 3.1-10.6 GHz band, an antenna having a conic or teardrop-shaped feeding body disposed on a flat ground plate has been proposed (Taniguchi, T. and Takehiko Kobayashi (Tokyo Denki University); "An Omnidirectional and Low-VSWR Antenna for the FCC-approved UWB Frequency Band," Institute of Electronics, Information, and Communications Engineers, B-1-133, B201, Mar. 22, 2003).

However, since the conventional antenna device having a conic or teardrop-shaped feeding body disposed on a flat ground plate is large in size, there has been a demand for reduction in the size and thickness of the conventional antenna device.

Accordingly, there is proposed a technique that reduces the size and thickness of this type of antenna device by forming an element pattern and a ground pattern of conductive patterns on a dielectric substrate.

FIGS. 1A and 1B are diagrams showing a conventional antenna device 10.

The conventional antenna device 10 includes a dielectric substrate 11, an element pattern 12, a microstrip line 13, and a ground pattern 14.

The dielectric substrate 11 is formed of, for example, an FR-4 substrate having a length L31 of substantially 40 mm and a width W31 of substantially 30 mm. The element pattern 12 and the microstrip line 13 are formed on one side (surface) of the dielectric substrate 11, and the ground pattern 14 is formed on the other side (surface) of the dielectric substrate 11.

The element pattern 12 is shaped like a home plate and has a length L41 of substantially 15 mm and a width W41 of substantially 16 mm. The microstrip line 13 extends from a feeding point Ps of the element pattern 12.

The ground pattern 14 is formed on the X2 side of the feeding point Ps of the element pattern 12 on the other side (surface) of the dielectric substrate 11. The ground pattern 14 has a length L42 of substantially 25 mm and a width of substantially 30 mm, which is the same as the width W31 of the dielectric substrate 11.

Regarding loop antennas used for communications in low-frequency bands, an antenna device having an element formed with a conductive pattern on a flexible substrate has been proposed. (See, for example, Japanese Laid-Open Patent Application No. 2000-196327.)

In view of mounting these types of ultra-wide frequency band antenna devices in various communications devices, there is a strong demand for reduction in their sizes without degradation of characteristics such as VSWR.

SUMMARY OF THE INVENTION

Embodiments of the present invention may solve or reduce one or more of the above-described problems.

According to one embodiment of the present invention, there is provided an antenna device in which one or more of the above-described problems may be solved or reduced.

According to one embodiment of the present invention, there is provided an antenna device that can be reduced in size without degradation of its characteristics.

According to one embodiment of the present invention, there is provided an antenna device including a dielectric substrate having first and second surfaces facing away from each other, an element pattern formed on the first surface of the dielectric substrate, a conductive pattern formed on the first surface of the dielectric substrate so as to extend from a feeding point of the element pattern, and a ground pattern formed on the second surface of the dielectric substrate so as to form a microstrip line in cooperation with the conductive pattern, wherein the ground pattern has a cutout part formed in a portion thereof opposing the feeding point.

According to one aspect of the present invention, by providing a cutout part in a portion of a ground pattern which portion opposes a feeding point of an element pattern in an antenna device having the element pattern formed on one side (surface) of a dielectric substrate, a conductive (line) pattern formed on the one side of the dielectric substrate so as to extend from the element pattern, and the ground pattern formed on the other side (surface) of the dielectric substrate so as to oppose the conductive pattern, it is possible to reduce the size of the antenna device without degradation of its frequency characteristic in a desired frequency band (for example, 3 to 5 GHz).

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given below, with reference to the accompanying drawings, of embodiments of the present invention.

First Embodiment

Figure 1A:
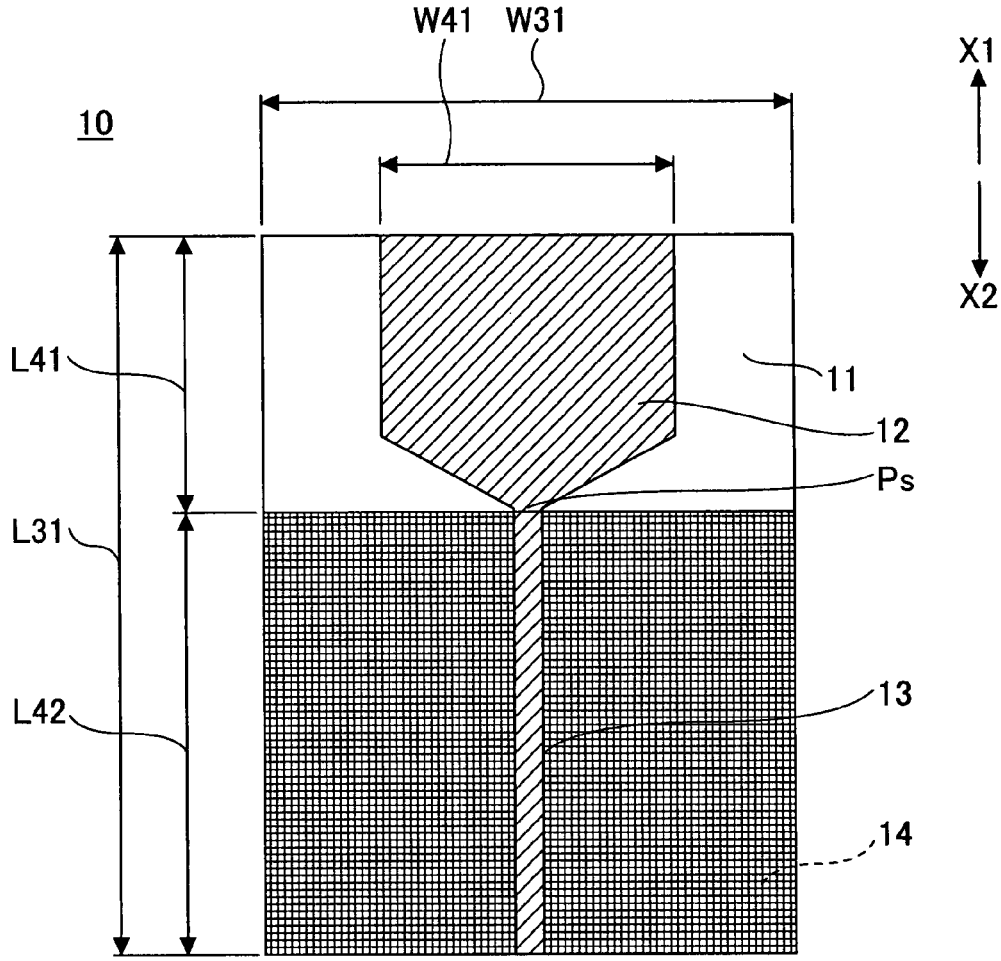
FIGS. 1A and 1B are diagrams showing a conventional antenna device.
Figure 1B:
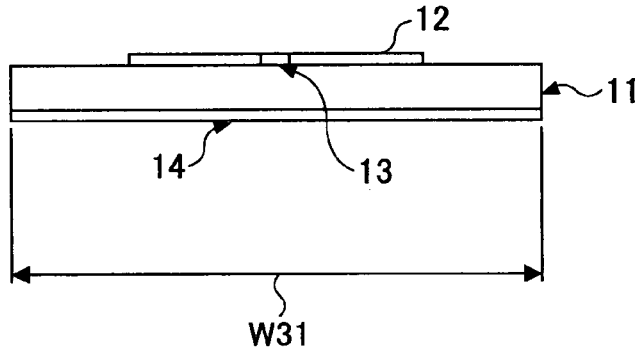
Figure 2A:
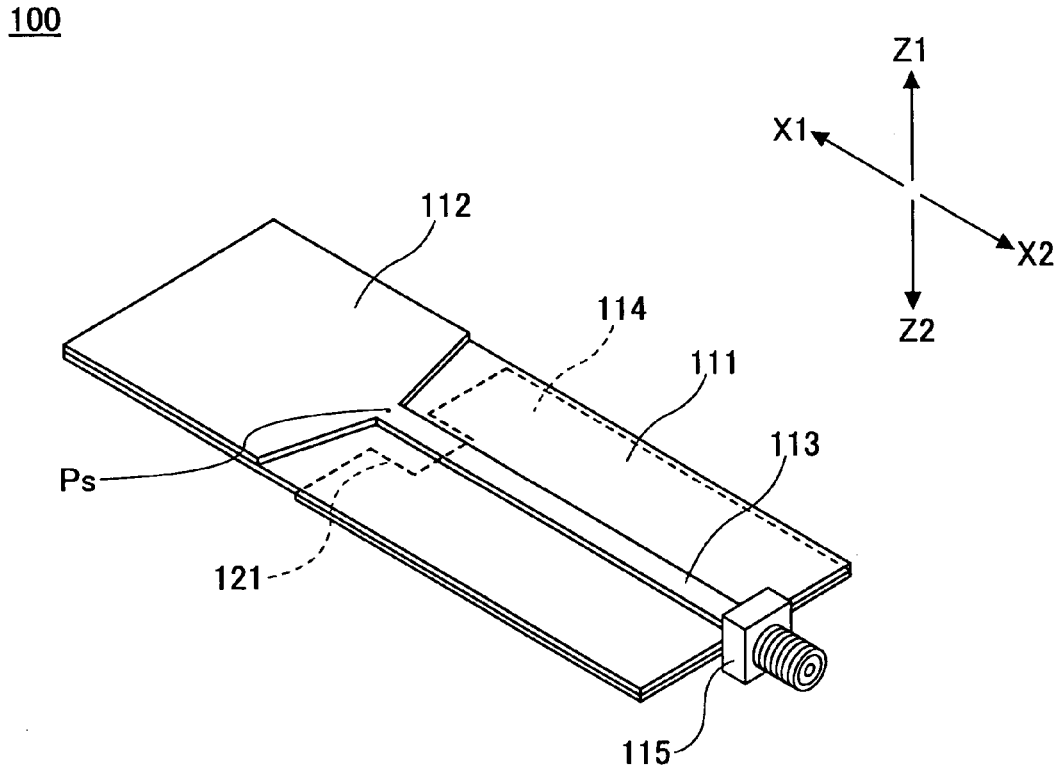
FIGS. 2A and 2B are perspectives views of an antenna device on a first surface and a second surface, respectively, thereof according to a first embodiment of the present invention.
Figure 2B:
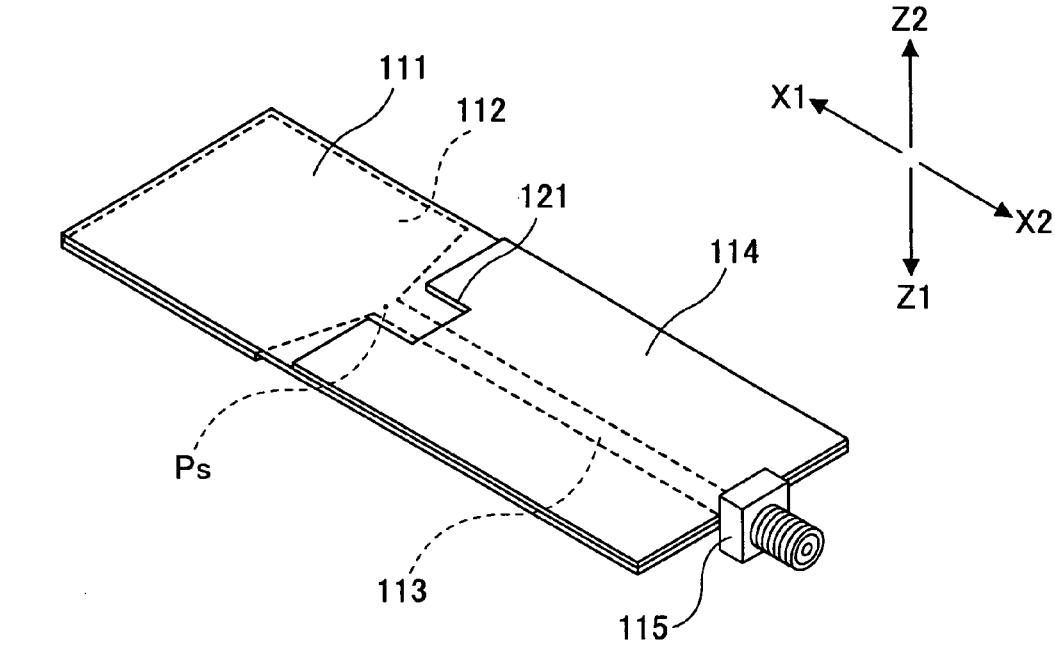
Figure 3A:
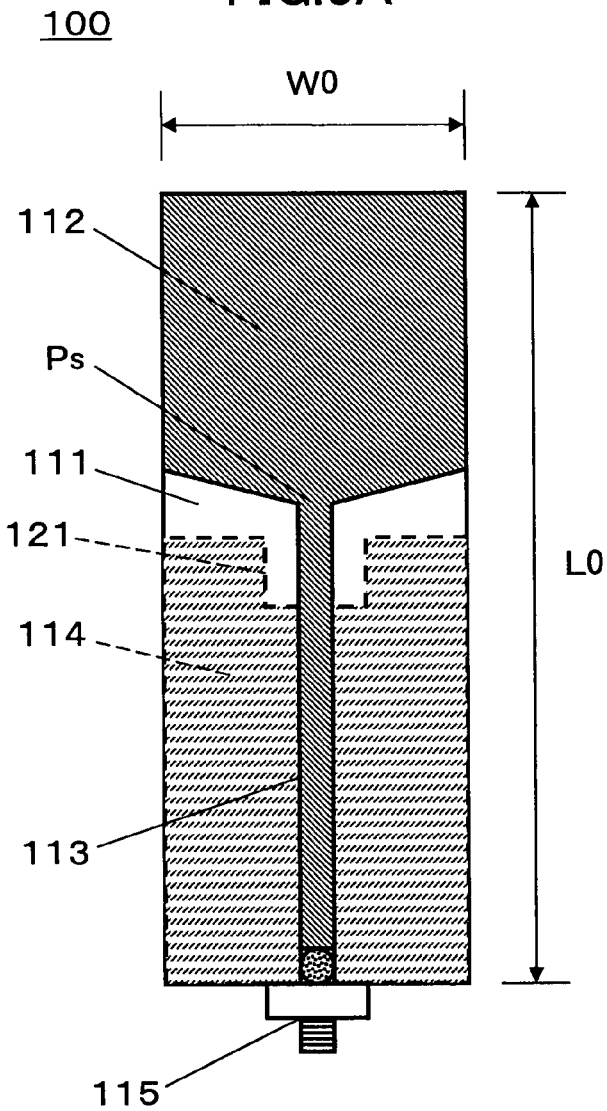
FIGS. 3A through 3C are a top plan view, a side view, and a longitudinal side view, respectively, of the antenna device according to the first embodiment of the present invention.
Figure 3C:
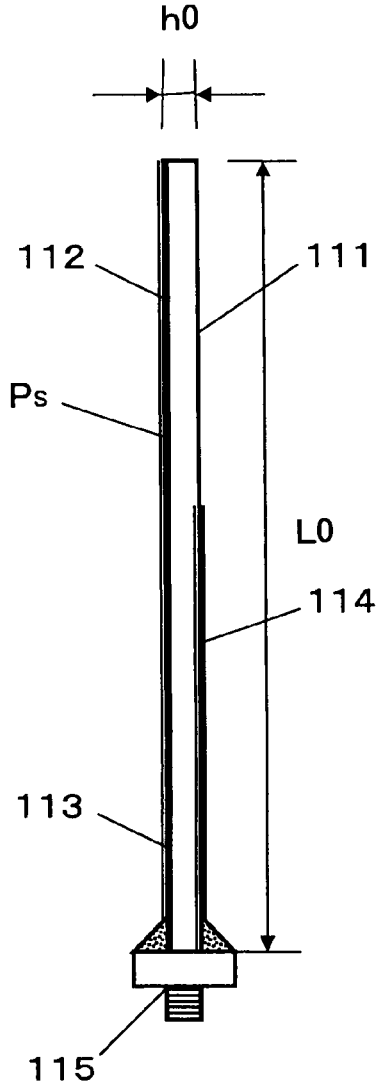
Figure 3B:
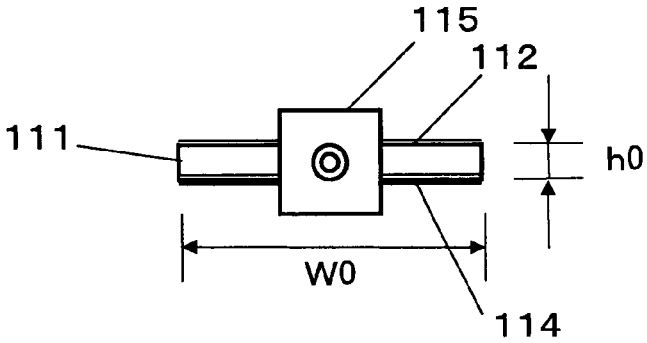

FIGS. 2A and 2B are perspectives views of an antenna device 100 on a first side (surface) and a second side (surface), respectively, thereof according to a first embodiment of the present invention. FIGS. 3A through 3C are a top plan (Z1-side) view, an X2-side view, and a longitudinal side view, respectively, of the antenna device 100.

The antenna device 100 includes a dielectric substrate 111, an element pattern 112, a line pattern 113, and a ground pattern 114. The element pattern 112 and the line pattern 113 are formed on one side (first surface) of the dielectric substrate 111, and the ground pattern 114 is formed on the other side (second surface) of the dielectric substrate 111.

The dielectric substrate 111 is formed of, for example, an FR-4 substrate, and has a thickness h0 of substantially 0.8 mm, a width W0 of substantially 14 mm, and a length L0 of substantially 40 mm. (See FIGS. 3A through 3C for h0, W0, and L0.) The dielectric substrate 111 is not limited to the FR-4 substrate, and may be any substrate as long as it is formed of dielectric such as a ceramic material. Copper foil is formed on each surface of the dielectric substrate 111. The element pattern 112, the line pattern 113, and the ground pattern 114 are formed by etching the copper foil.

A description is given first of the element pattern 112 and the line pattern 113 formed on one side (first surface) of the dielectric substrate 111.

Figure 4:
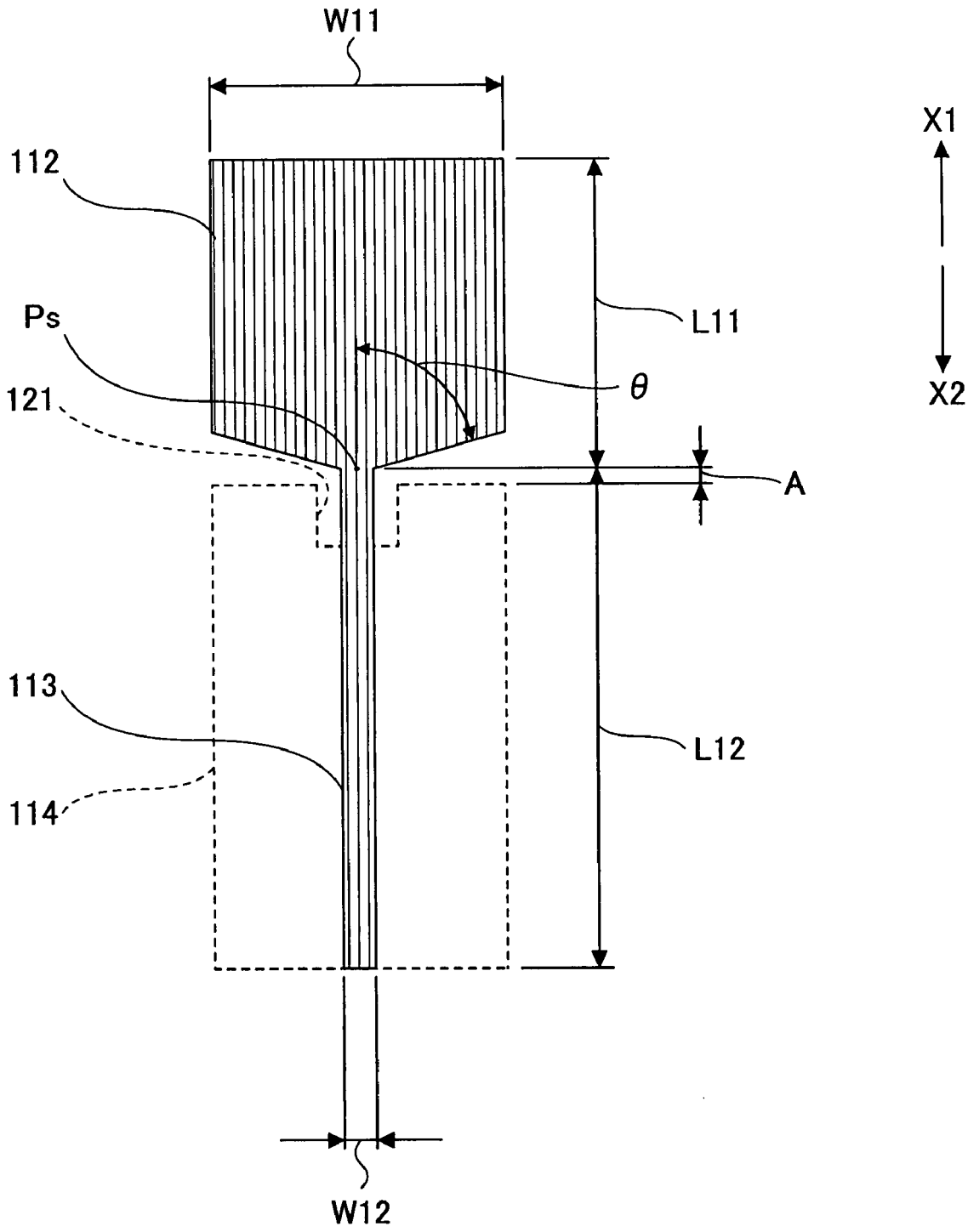
FIG. 4 is a plan view of an element pattern and a line pattern of the antenna device according to the first embodiment of the present invention.

FIG. 4 is a plan view of the element pattern 112 and the line pattern 113 according to the first embodiment.

The element pattern 112 is formed on the X1-directional side (side in the direction indicated by arrow X1) on the Z1-side surface (surface in the direction indicated by arrow Z1) (first surface) of the dielectric substrate 111. The element pattern 112 has a substantially pentagonal shape (home-plate shape) having a width W11 of substantially 14 mm and a length L11 of substantially 15 mm. Each of the two sides of the element pattern 112 pinching a feeding point Ps, that is, each of the two sides of the element pattern 112 connected to the line pattern 113, forms an angle θ (FIG. 4) of substantially 80° to 85° with respect to the directions indicated by arrows X1 and X2 in FIG. 4, in which the line pattern 113 extends.

In the case of FIG. 4, θ may be the angle formed between each of the two sides of the element pattern 112 and the center line of the element pattern 112 passing through the feeding point Ps.

Here, each of the two sides of the element pattern may be angled, that is, the angle θ may be determined, in accordance with the shape of a cutout part 121 (described below with reference to FIG. 5 of the ground pattern 114.

Further, the angle of each of the two sides of the element pattern 112 with respect to the ground pattern 114 and the shape of the cutout part 121 of the ground pattern 114 may be determined so that the antenna device 100 has a desired frequency characteristic.

The line pattern 113 is formed on the Z1-side surface of the dielectric substrate 111 so as to extend in the X2 direction from the feeding point Ps of the element pattern 112. The line pattern 113 has a length L12 of substantially 25 mm and a width W12 of substantially 1.5 mm. The line pattern 113 forms a microstrip line in cooperation with the ground pattern 114.

Next, a description is given of the ground pattern 114 formed on the other side (second surface) of the dielectric substrate 111.

Figure 5:
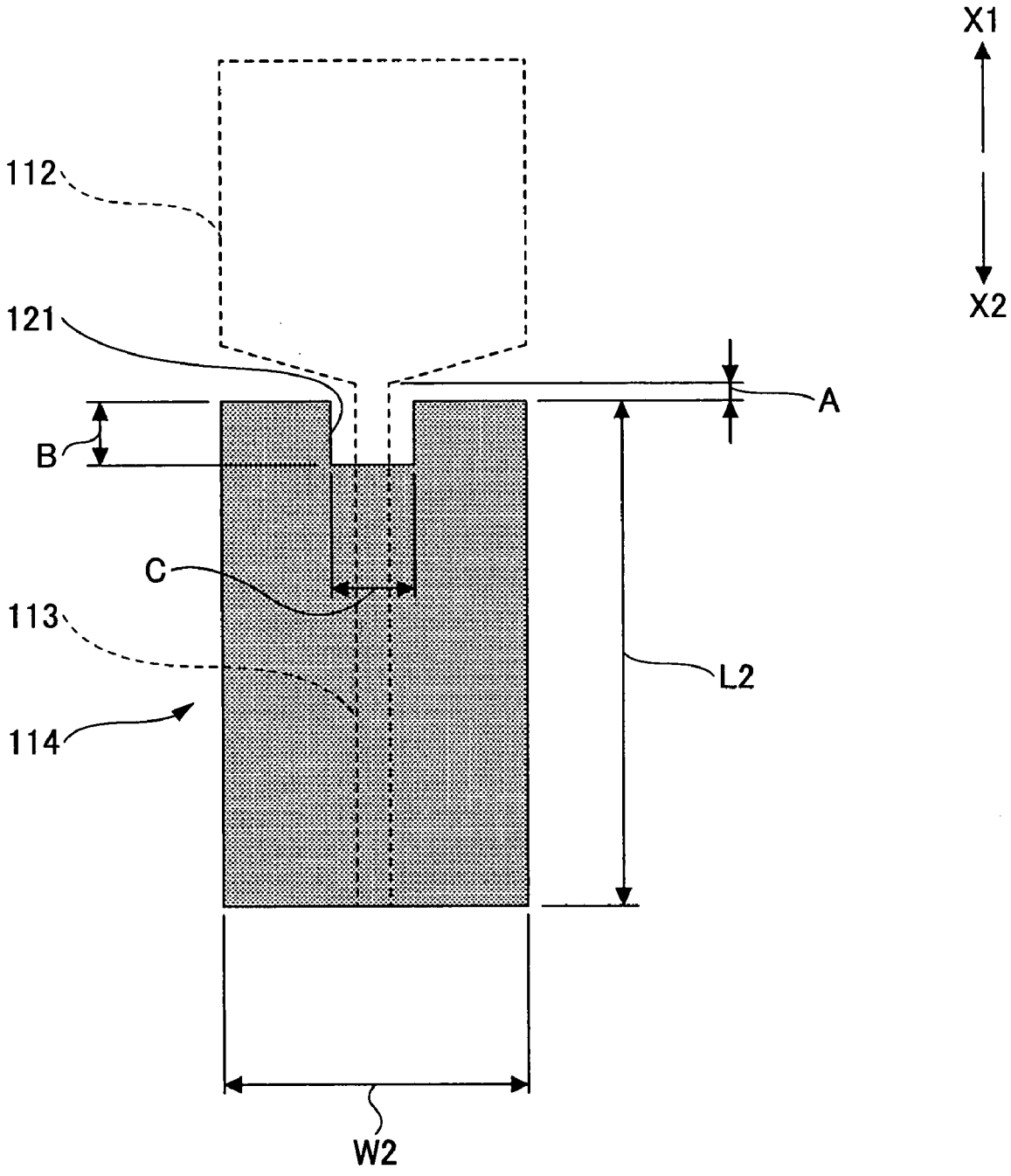
FIG. 5 is a plan view of a ground pattern of the antenna device according to the first embodiment of the present invention.

FIG. 5 is a plan view of the ground pattern 114 according to the first embodiment.

The ground pattern 114 is formed on the X2-directional side (side in the direction indicated by arrow X2) of the feeding point Ps of the element pattern 112 on the Z2-side surface (surface in the direction indicated by arrow Z2) (second surface) of the dielectric substrate 111. The ground pattern 114 has a width W2 of substantially 14 mm, which is the same as the width W11 of the element pattern 112, and a length L2 of substantially 24 mm.

The cutout part 121 is formed in the center of the X1-directional end side of the ground pattern 114. The cutout part 121 has a substantially rectangular shape. The cutout part 121 is formed at a position opposing the feeding point Ps of the element pattern 112 on the side of the ground pattern 114 opposing the feeding point Ps. In other words, the cutout part 121 may be formed in an end portion of the ground pattern 114, which end portion is positioned opposite the feeding point Ps in plan view or when viewing the antenna device 100 in a direction of the thickness of the dielectric substrate 111.

The cutout part 121 has a depth B and a width C each of, for example, substantially 5.0 mm.

There is a gap A between the feeding point Ps of the element pattern 112 and the X1-directional end side of the ground pattern 114. The gap A is, for example, substantially 1 mm along the X-axis. The length L2 of the ground pattern 114 may be substantially 24 mm including the gap A.

Next, a description is given of a frequency characteristic obtained by the antenna device 100.

Figure 6:
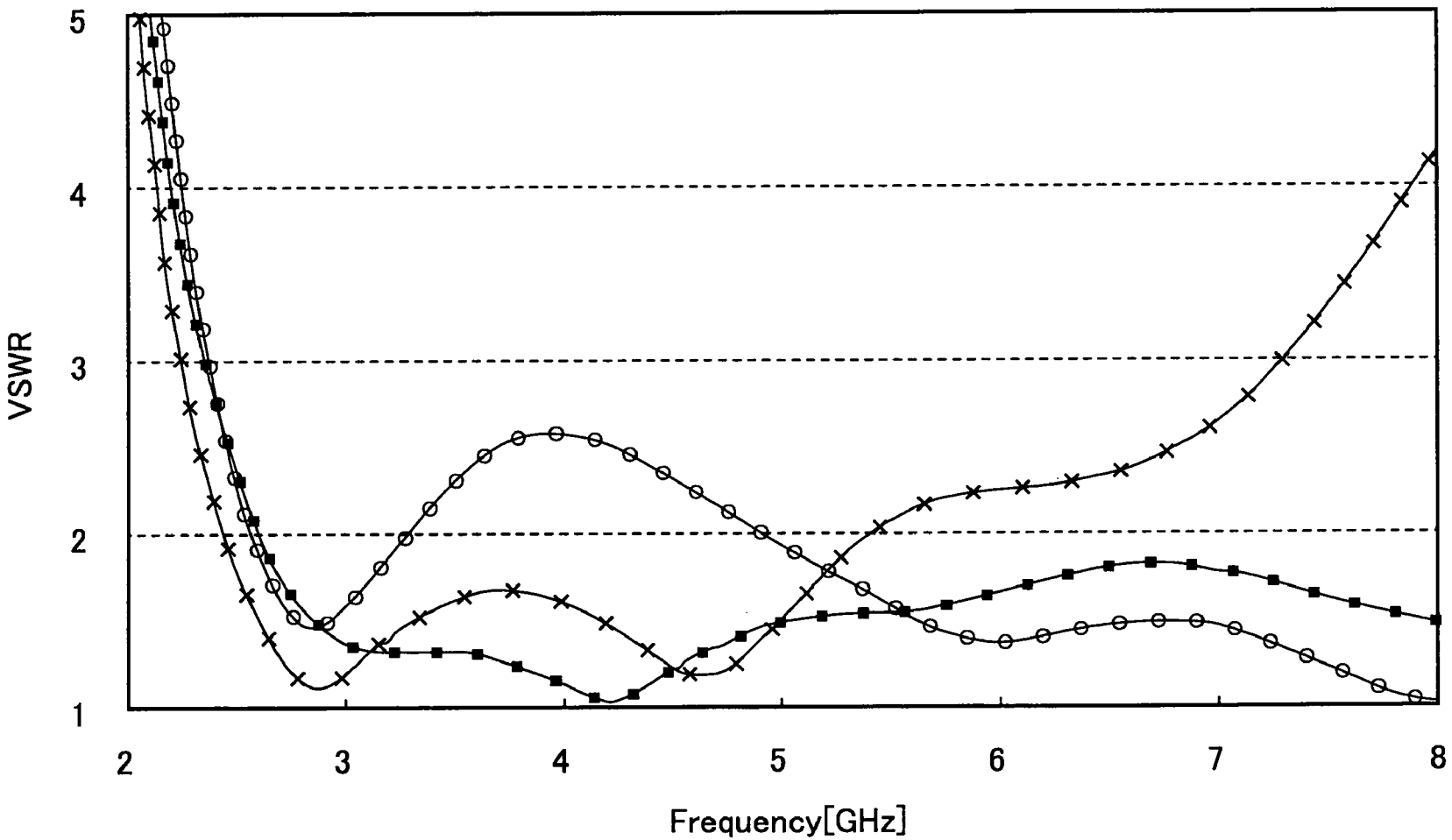
FIG. 6 is a graph showing the VSWR characteristic of the antenna device according to the first embodiment of the present invention.

FIG. 6 is a graph showing the VSWR characteristic of the antenna device 100. In FIG. 6, a cross indicates the VSWR characteristic of the antenna device 100, a black square indicates the VSWR characteristic of the conventional antenna device 10, and a white circle indicates the VSWR of the conventional antenna device 10 with reduced width.

As indicated by crosses in FIG. 6, the VSWR of the antenna device 100 of this embodiment is less than 2 between 2.5 and 5.5 GHz. VSWR stands for Voltage Standing Wave Ratio, and indicates the peak-to-bottom ratio of a voltage amplitude distribution generated on a transmission line in which reflected waves are generated because of impedance mismatching.

In UWB communications, it is desired that VSWR be less than substantially 2 in a wide frequency band. Accordingly, the antenna device 100 of this embodiment, which is reduced in size, sufficiently satisfies the characteristic desired for UWB communications in a frequency band of 2.5 to 5.5 GHz.

Figure 7:
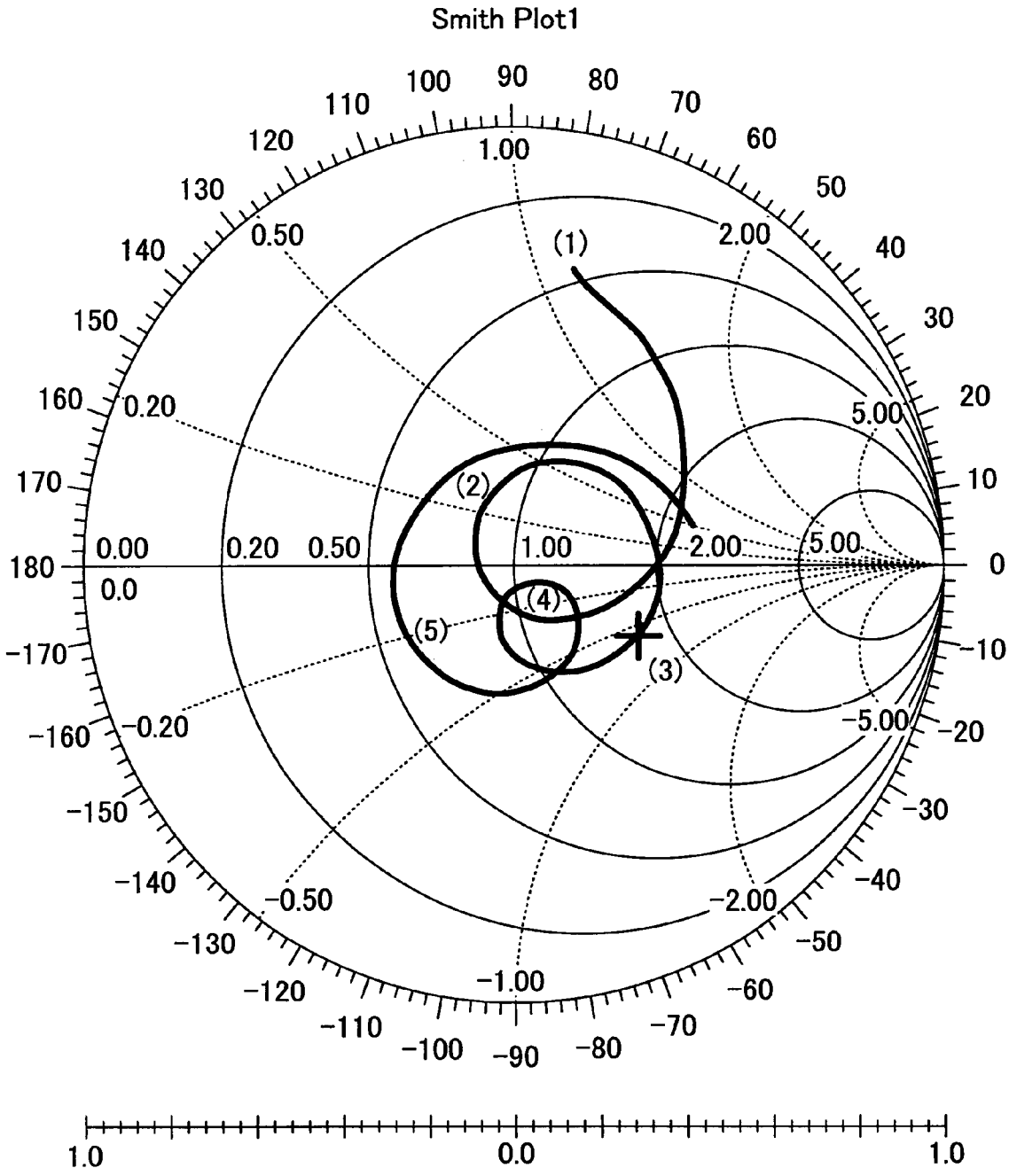
FIG. 7 is a Smith chart of the antenna device according to the first embodiment of the present invention.
Figure 8:
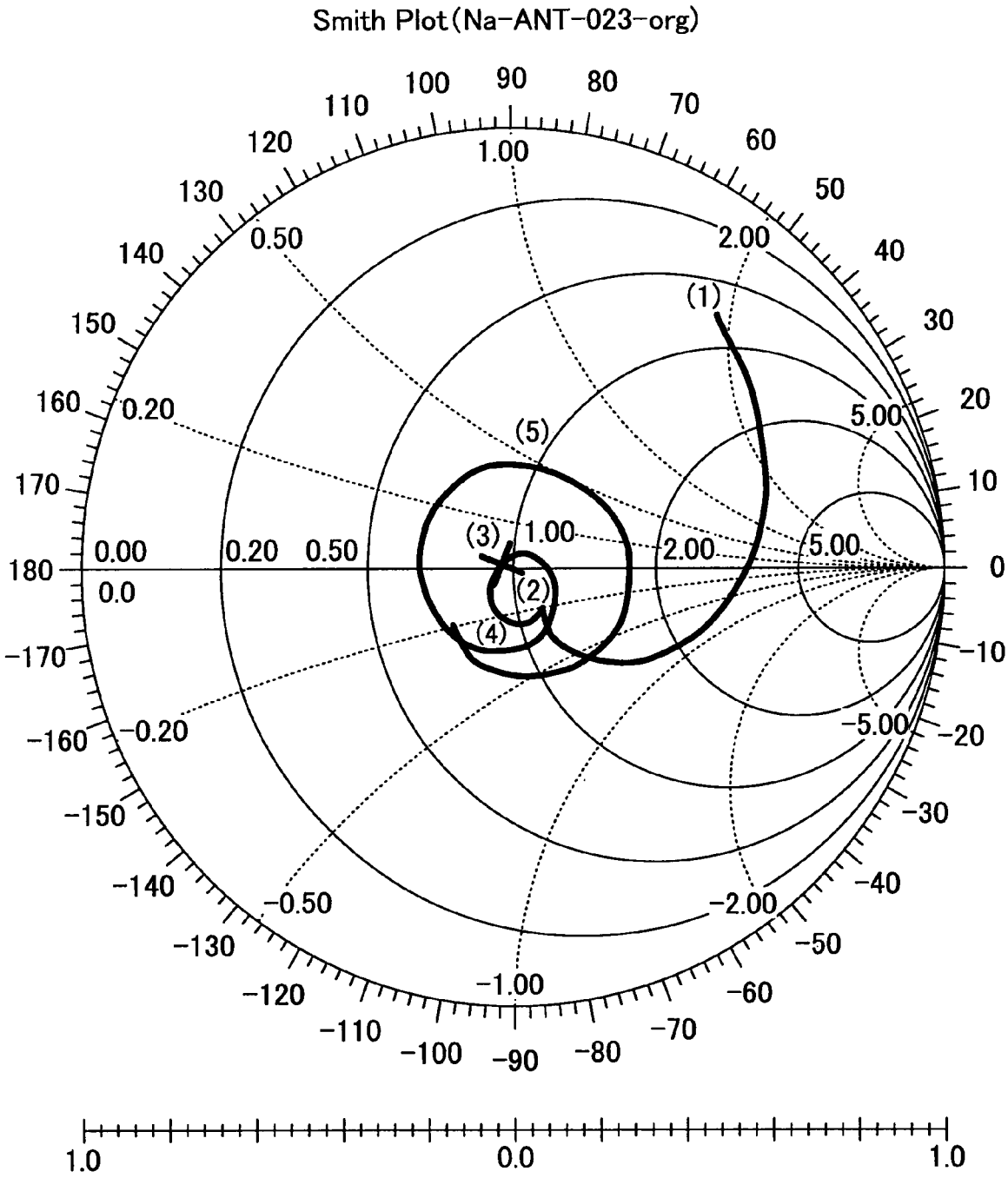
FIG. 8 is a Smith chart of the conventional antenna device shown in FIGS. 1A and 1B.
Figure 9:
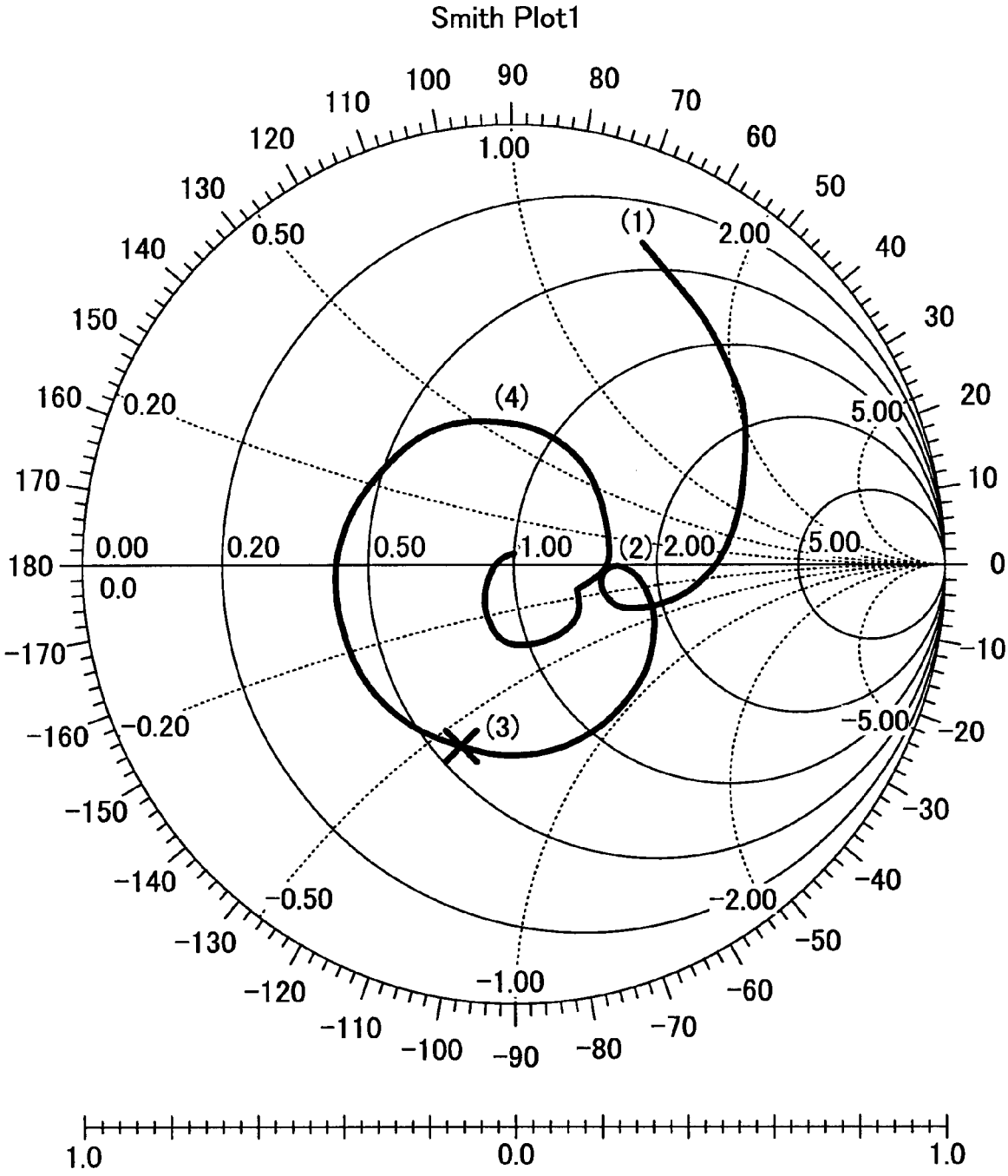
FIG. 9 is a Smith chart of the conventional antenna device with reduced width.

FIG. 7 is a Smith chart of the antenna device 100. FIG. 8 is a Smith chart of the conventional antenna device 10. FIG. 9 is a Smith chart of the conventional antenna device 10 with reduced width.

The cross indicates impedance at 4.0 GHz in FIGS. 7 and 9 and indicates impedance at 4.2 GHz in FIG. 8.

As shown in FIG. 8, the impedance is controlled to be substantially 50 Ω around 4.2 GHz in the conventional antenna device 10. Further, as shown in FIG. 7, the impedance is also controlled to be substantially 50 Ω around 4.0 GHz in the antenna device 100 of this embodiment the same as in the conventional antenna device 10. Thus, the antenna device 100 of this embodiment has substantially the same characteristic as the conventional antenna device 10.

As shown in FIG. 9, however, simply making the conventional antenna device 10 as narrow in width as the antenna device 100 of this embodiment results in an impedance greater than 50 Ω at 4.0 GHz, thus preventing the conventional antenna device 10 with reduced width from having the same characteristic as the conventional antenna device 10.

Thus, the same characteristic as the conventional antenna device 10 cannot be obtained if the width of the conventional antenna device 10 is only reduced. However, by providing the cutout part 121 and adjusting the angle of each of the sides of the element pattern 112 between which the feeding point Ps is positioned with respect to the above-described line passing through the feeding point Ps, it is possible to obtain substantially the same frequency characteristic as the conventional antenna device 10 even with reduced width.

By shaping the ground pattern 114 as shown in FIG. 5, it is possible to improve the VSWR characteristic in a frequency band of 3 to 5 GHz in the antenna device 100, which is reduced in width, that is, in size, compared with the case of simply narrowing the width of the conventional antenna device 10.

Thus, according to this embodiment, by providing the cutout part 121 in the ground pattern 114 around the feeding point Ps of the element pattern 112, it is possible to prevent degradation of the VSWR characteristic while reducing the widths of the element pattern 112 and the ground pattern 114, even when the element pattern 112 and the ground pattern 114 have the same width. Accordingly, it is possible to achieve the downsized antenna device 100 without degradation of the VSWR characteristic.

Second Embodiment

Figure 10A:
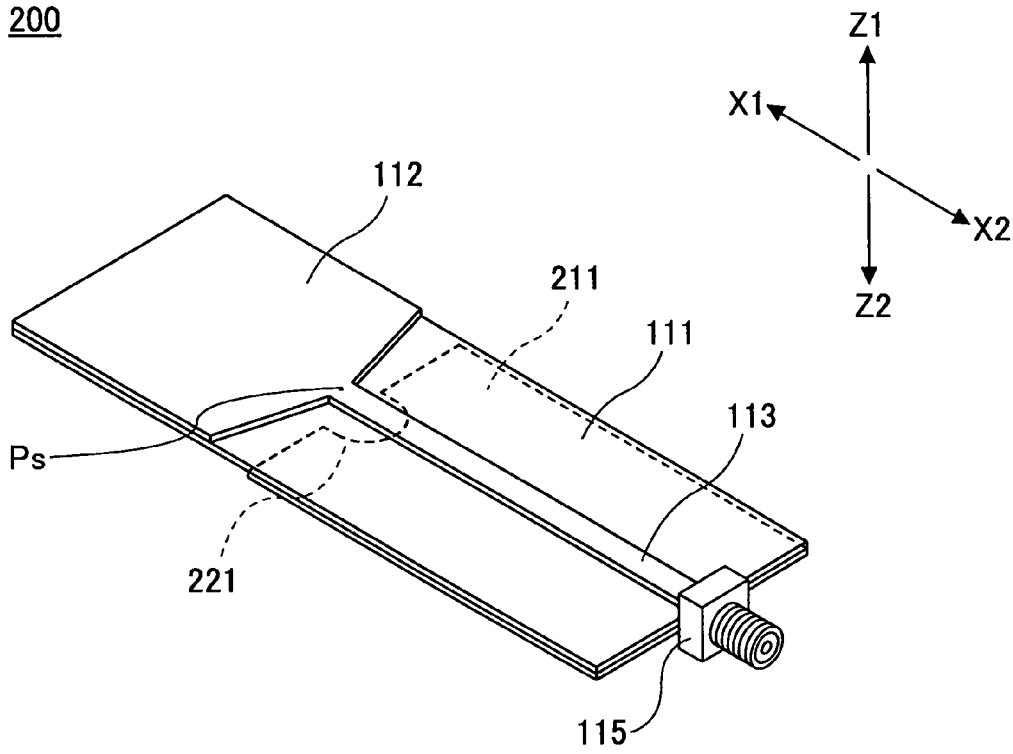
FIGS. 10A and 10B are perspective views of an antenna device on a first surface and a second surface, respectively, thereof according to a second embodiment of the present invention.
Figure 10B:
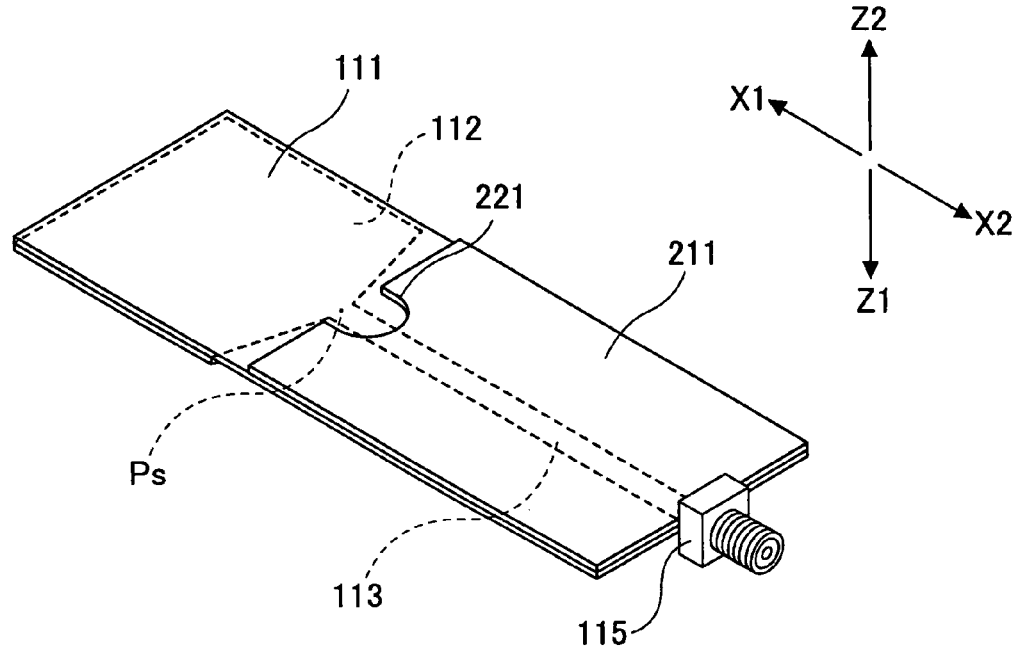
Figure 11A:
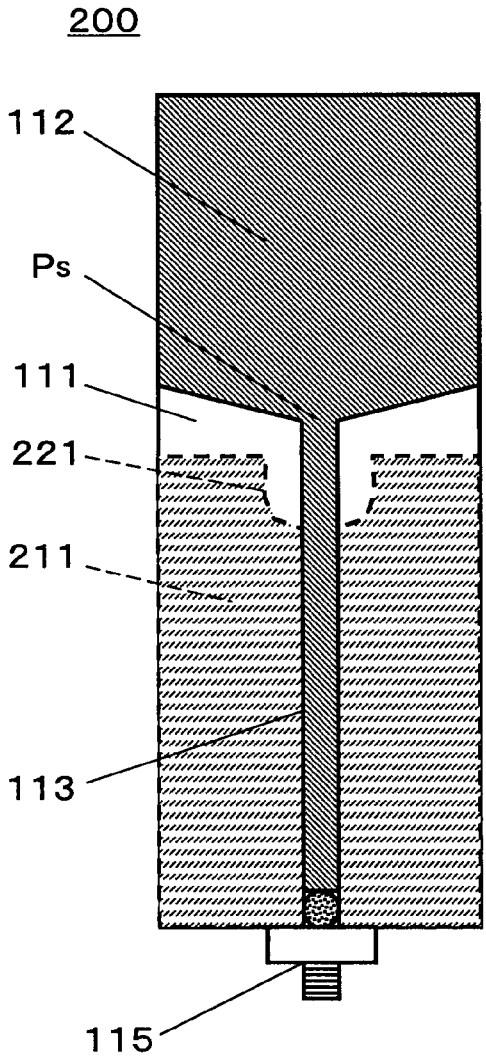
FIGS. 11A through 11C are a top plan view, a side view, and a longitudinal side view, respectively, of the antenna device according to the second embodiment of the present invention.
Figure 11C:
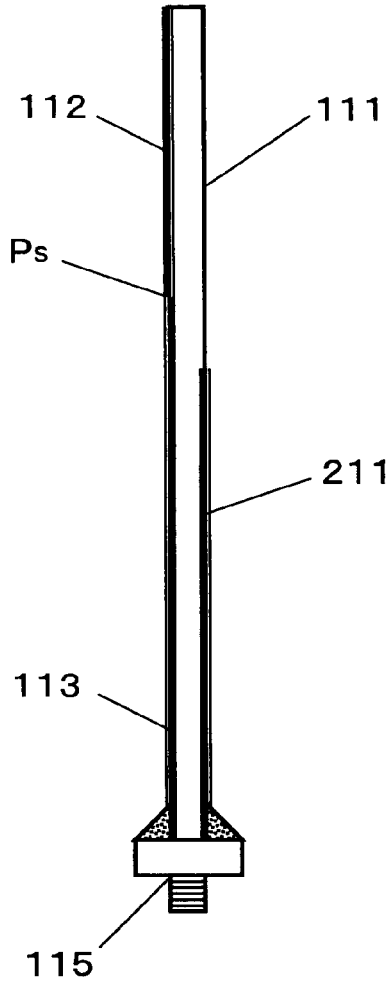
Figure 11B:
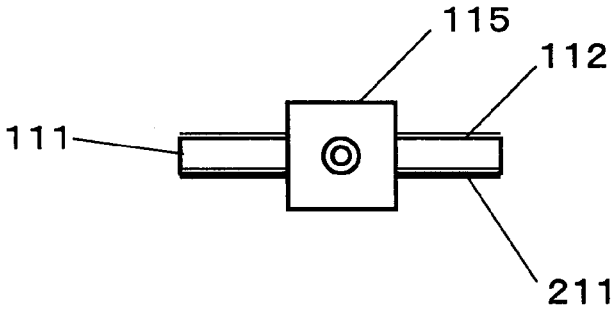

FIGS. 10A and 10B are perspectives views of an antenna device 200 on a first side (surface) and a second side (surface), respectively, thereof according to a second embodiment of the present invention. FIGS. 11A through 11C are a top plan (Z1-side) view, an X2-side view, and a longitudinal side view, respectively, of the antenna device 200.

In FIGS. 10A, 10B, and 11A through 11C, the same elements as those described above in the first embodiment are referred to by the same reference numerals, and a description thereof is omitted.

The antenna device 200 is different from the antenna device 100 of the first embodiment in the shape of the cutout part formed in the ground pattern.

The antenna device 200 includes a ground pattern 211 in which a cutout part 221 is formed. The cutout part 221 of this embodiment has a curved shape, for example, a semicircular shape.

Since the cutout part 221 is provided with a curved feature, it is possible to moderate the effect of the cutout part 221 on characteristics of the antenna device 200, thus making it easy to control the characteristics.

According to one embodiment of the present invention, there is provided an antenna device including a dielectric substrate having first and second surfaces facing away from each other, an element pattern formed on the first surface of the dielectric substrate, a conductive pattern formed on the first surface of the dielectric substrate so as to extend from the feeding point of the element pattern, and a ground pattern formed on the second surface of the dielectric substrate so as to form a microstrip line in cooperation with the conductive pattern, wherein the ground pattern has a cutout part formed in a portion thereof opposing the feeding point.

According to one aspect of the present invention, by providing a cutout part in a portion of a ground pattern which portion opposes a feeding point of an element pattern in an antenna device having the element pattern formed on one side (surface) of a dielectric substrate, a conductive (line) pattern formed on the one side of the dielectric substrate so as to extend from the element pattern, and the ground pattern formed on the other side (surface) of the dielectric element so as to oppose the conductive pattern, it is possible to reduce the size of the antenna device without degradation of its frequency characteristic in a desired frequency band (for example, 3 to 5 GHz).

The present invention is not limited to the specifically disclosed embodiments, and variations and modifications may be made without departing from the scope of the present invention.

What is claimed is:

1. An antenna device, comprising:

a dielectric substrate having first and second surfaces facing away from each other;

an element pattern formed on the first surface of the dielectric substrate;

a conductive pattern formed on the first surface of the dielectric substrate so as to extend from a feeding point of the element pattern; and a ground pattern formed on the second surface of the dielectric substrate so as to form a microstrip line in cooperation with the conductive pattern, wherein the ground pattern has a cutout part formed in a portion thereof opposing the feeding point, and the cutout part is open on a side of the feeding point.

2. The antenna device as claimed in claim 1, wherein the element pattern comprises a first side and a second side between which the feeding point is positioned; and each of the first and second sides of the element pattern is angled in accordance with a shape of the cutout part of the ground pattern.

3. The antenna device as claimed in claim 1, wherein the cutout part has a rectangular shape.

4. The antenna device as claimed in claim 1, wherein the cutout part has a curved shape.

5. The antenna device as claimed in claim 4, wherein the cutout part has a semicircular shape.

6. The antenna device as claimed in claim 1, wherein the element pattern comprises a first side and a second side between which the feeding point is positioned; and an angle of each of the first and second sides of the element pattern with respect to the ground pattern and a shape of the cutout part of the ground pattern are determined so that the antenna device has a desired frequency characteristic.

7. The antenna device as claimed in claim 6, wherein the angle of each of the first and second sides of the element pattern with respect to the ground pattern and the shape of the cutout part of the ground pattern are determined so that a VSWR of the antenna device is less than a predetermined value in a frequency band of 2.5 to 5.5 GHz.

8. The antenna device as claimed in claim 1, wherein a width of the element pattern is equal to a width of the ground pattern.

9. The antenna device as claimed in claim 1, wherein the antenna device is used for UWB communications.

10. The antenna device as claimed in claim 1, wherein the element pattern and the ground pattern are prevented from facing each other across the dielectric substrate.

* * * * *